US011245216B2

(12) United States Patent
Zhao et al.

(10) Patent No.: US 11,245,216 B2
(45) Date of Patent: Feb. 8, 2022

(54) ELECTRICAL CONNECTOR UPPER AND LOWER CONTACTS MADE FROM A SINGLE CONTACT CARRIER AND INCLUDING TWO OUTERMOST CONTACTS WITH INTEGRAL LATCHING PORTIONS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 64 days.

(21) Appl. No.: 16/664,957

(22) Filed: Oct. 28, 2019

(65) Prior Publication Data

US 2020/0136291 A1 Apr. 30, 2020

(30) Foreign Application Priority Data

Oct. 29, 2018 (CN) ..... 201811265469.2

(51) Int. Cl.
*H01R 13/405* (2006.01)
*H01R 43/16* (2006.01)
(Continued)

(52) U.S. Cl.
CPC ..... *H01R 13/405* (2013.01); *H01R 4/02* (2013.01); *H01R 12/725* (2013.01);
(Continued)

(58) Field of Classification Search
CPC .. H01R 2107/00; H01R 24/60; H01R 13/405; H01R 43/24; H01R 13/6581;
(Continued)

(56) References Cited

U.S. PATENT DOCUMENTS 5,848,920 A * 12/1998 Klein ..... H01R 43/16 439/885
6,764,357 B2 * 7/2004 Wu ..... H01R 43/20 439/637
(Continued)

FOREIGN PATENT DOCUMENTS

CN 102280735 A 12/2011
CN 104882696 A 9/2015
(Continued)

*Primary Examiner* — Edwin A. Leon
*Assistant Examiner* — Matthew T Dzierzynski
(74) *Attorney, Agent, or Firm* — Ming Chieh Chang; Wei Te Chung

(57) ABSTRACT

A method of making a contact module of an electrical connector which includes a tongue and plural contacts exposed to two opposite surfaces of the tongue is characterized by the steps of: forming the contacts from a single contact carrier to have one contact thereof with a first contacting portion oriented reversely-symmetrically with respect to a second contacting portion of another contact thereof and to have two outermost contacts each with a respective integral latching portion; insert-molding the contacts with a first insulator while exposing front ends thereof and the latching portions; severing a carrier strip from the front ends of the plurality of contacts; and over-molding a second insulator to the first insulator and embedding the front ends of the plurality of contacts.

13 Claims, 13 Drawing Sheets

(51) Int. Cl.

| | |
|---|---|
| ***H01R 43/20*** | (2006.01) |
| ***H01R 13/6581*** | (2011.01) |
| ***H01R 4/02*** | (2006.01) |
| ***H01R 12/72*** | (2011.01) |
| ***H01R 13/502*** | (2006.01) |
| ***H01R 107/00*** | (2006.01) |

(52) U.S. Cl.
CPC ..... *H01R 13/502* (2013.01); *H01R 13/6581* (2013.01); *H01R 43/16* (2013.01); *H01R 43/20* (2013.01); *H01R 2107/00* (2013.01)

(58) Field of Classification Search
CPC .. H01R 13/6585; H01R 43/16; H01R 12/724; H01R 13/6594; H01R 24/62; H01R 12/721; H01R 13/504; H01R 12/725; H01R 13/6582; H01R 43/20; H01R 4/02; H01R 12/57; H01R 12/58; H01R 12/716; H01R 13/04; H01R 13/502; H01R 13/5216; H01R 13/64; H01R 13/6471; H01R 13/6587; H01R 24/28
See application file for complete search history.

(56) References Cited

U.S. PATENT DOCUMENTS

| | | | | |
|---|---|---|---|---|
| 7,621,788 | B1 * | 11/2009 | Feng | H01R 43/16 439/885 |
| 7,845,961 | B2 * | 12/2010 | Zhu | H01R 24/62 439/108 |
| 7,927,159 | B2 * | 4/2011 | Zhang | H01R 43/16 439/885 |
| 8,118,625 | B2 * | 2/2012 | Tsai | H01R 12/52 439/885 |
| 8,894,451 | B2 * | 11/2014 | Shiratori | H01R 13/04 439/885 |
| 9,153,920 | B2 * | 10/2015 | Kamei | H01R 13/655 |
| 9,368,917 | B2 * | 6/2016 | Allwood | H01R 13/659 |
| 9,484,662 | B2 * | 11/2016 | Guo | H01R 13/504 |
| 9,553,411 | B2 * | 1/2017 | Reinhardt | H01R 13/516 |
| 9,755,336 | B2 * | 9/2017 | Cheng | H01R 43/16 |
| 9,774,130 | B2 * | 9/2017 | Zhao | H01R 12/716 |
| 9,780,496 | B2 * | 10/2017 | Guo | H01R 13/6585 |
| 9,882,316 | B2 * | 1/2018 | Chen | H01R 13/405 |
| 9,960,543 | B2 * | 5/2018 | Chen | B29C 70/72 |
| 9,979,152 | B2 * | 5/2018 | Zhang | H01R 13/405 |
| 10,116,107 | B2 * | 10/2018 | Tada | H01R 4/02 |
| 10,135,204 | B2 * | 11/2018 | Zhang | H01R 13/6593 |
| 10,468,796 | B2 * | 11/2019 | Ju | H01R 13/6477 |
| 2017/0373439 | A1 | 12/2017 | Wen et al. | |

FOREIGN PATENT DOCUMENTS

| | | |
|---|---|---|
| CN | 105449398 A | 3/2016 |
| CN | 105024197 B | 4/2018 |
| CN | 207572614 U | 7/2018 |

* cited by examiner

ELECTRICAL CONNECTOR UPPER AND LOWER CONTACTS MADE FROM A SINGLE CONTACT CARRIER AND INCLUDING TWO OUTERMOST CONTACTS WITH INTEGRAL LATCHING PORTIONS

BACKGROUND OF THE INVENTION

1. Field of the Invention

The present invention relates to an electrical connector including: an insulative housing having a front tongue with two opposite surfaces, and a plurality of contacts with contacting portions exposed to the two opposite surfaces of the tongue, wherein the plurality of contacts are formed from a single contact carrier and are specially formed and oriented.

2. Description of Related Arts

U.S. Pat. No. 7,621,788 discloses an electrical connector pin carrier having a main panel, a secondary panel, and a set of first pins and a set of second pins both connected between the main panel and the secondary panel. The two sets of pins have respective contacting portions to be exposed to two opposite surfaces of an insulative housing tongue.

SUMMARY OF THE INVENTION

A method of making a contact module of an electrical connector which includes a tongue and plural contacts exposed to two opposite surfaces of the tongue is characterized by the steps of: forming the contacts from a single contact carrier to have one contact thereof with a first contacting portion oriented reversely-symmetrically with respect to a second contacting portion of another contact thereof and to have two outermost contacts each with a respective integral latching portion; insert-molding the contacts with a first insulator while exposing front ends thereof and the latching portions; severing a carrier strip from the front ends of the plurality of contacts; and over-molding a second insulator to the first insulator and embedding the front ends of the plurality of contacts.

DETAILED DESCRIPTION OF THE PREFERRED EMBODIMENT

Figure 1:
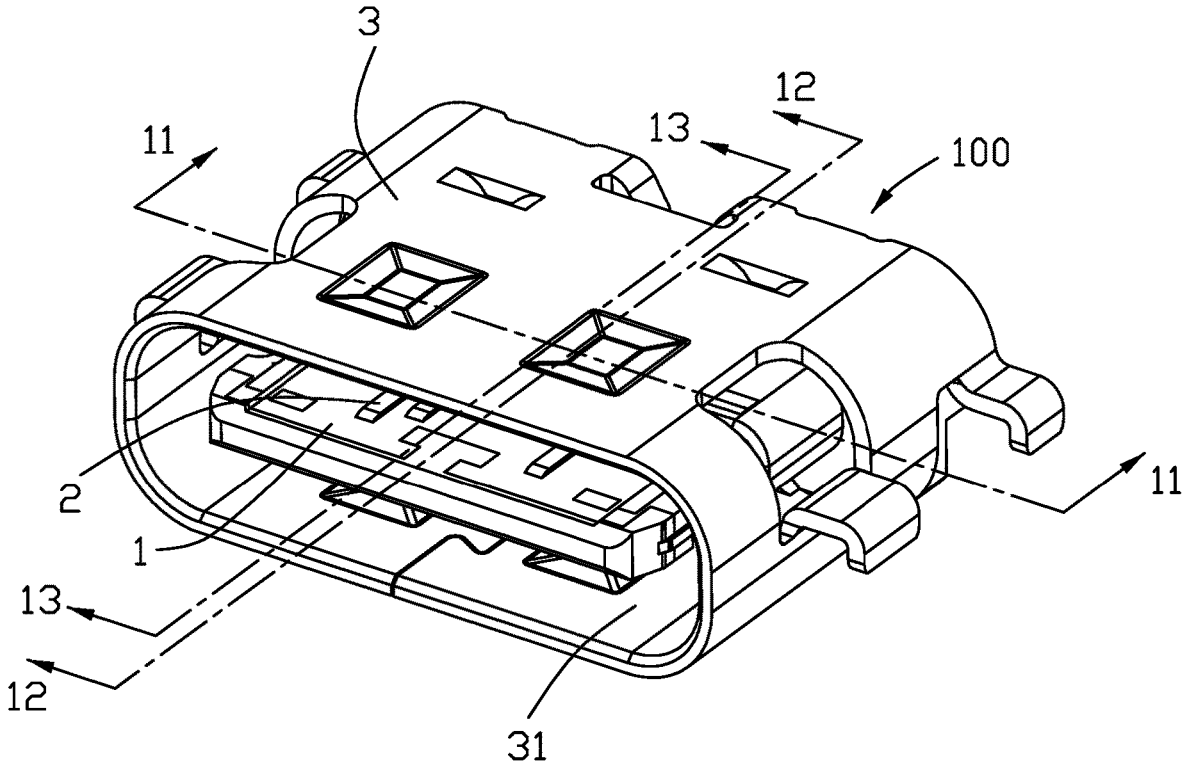
FIG. 1 is a top perspective view of an electrical connector in accordance with the present invention.
Figure 2:
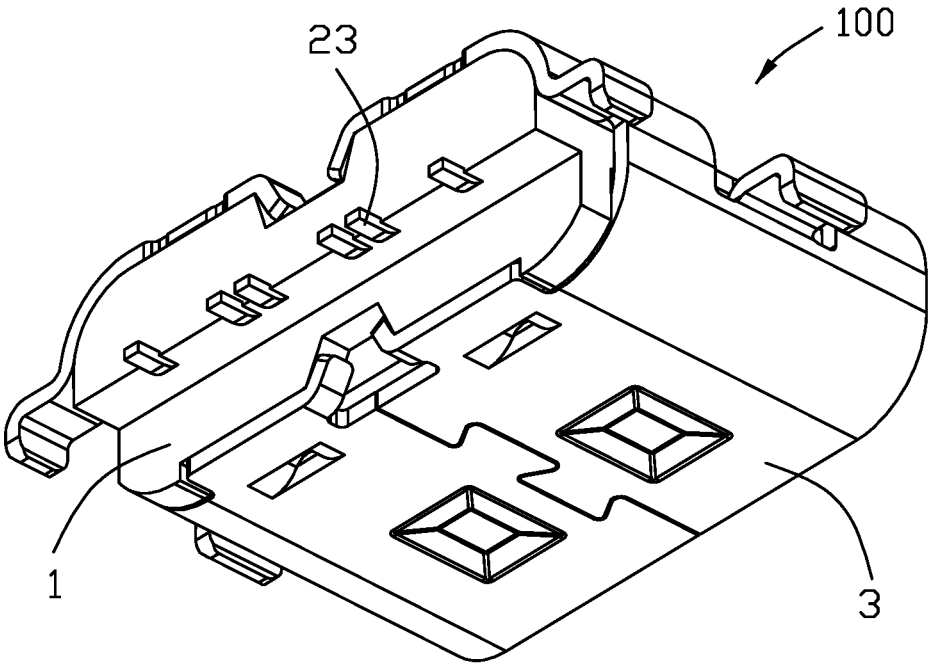
FIG. 2 is a bottom perspective view of the electrical connector.
Figure 3:
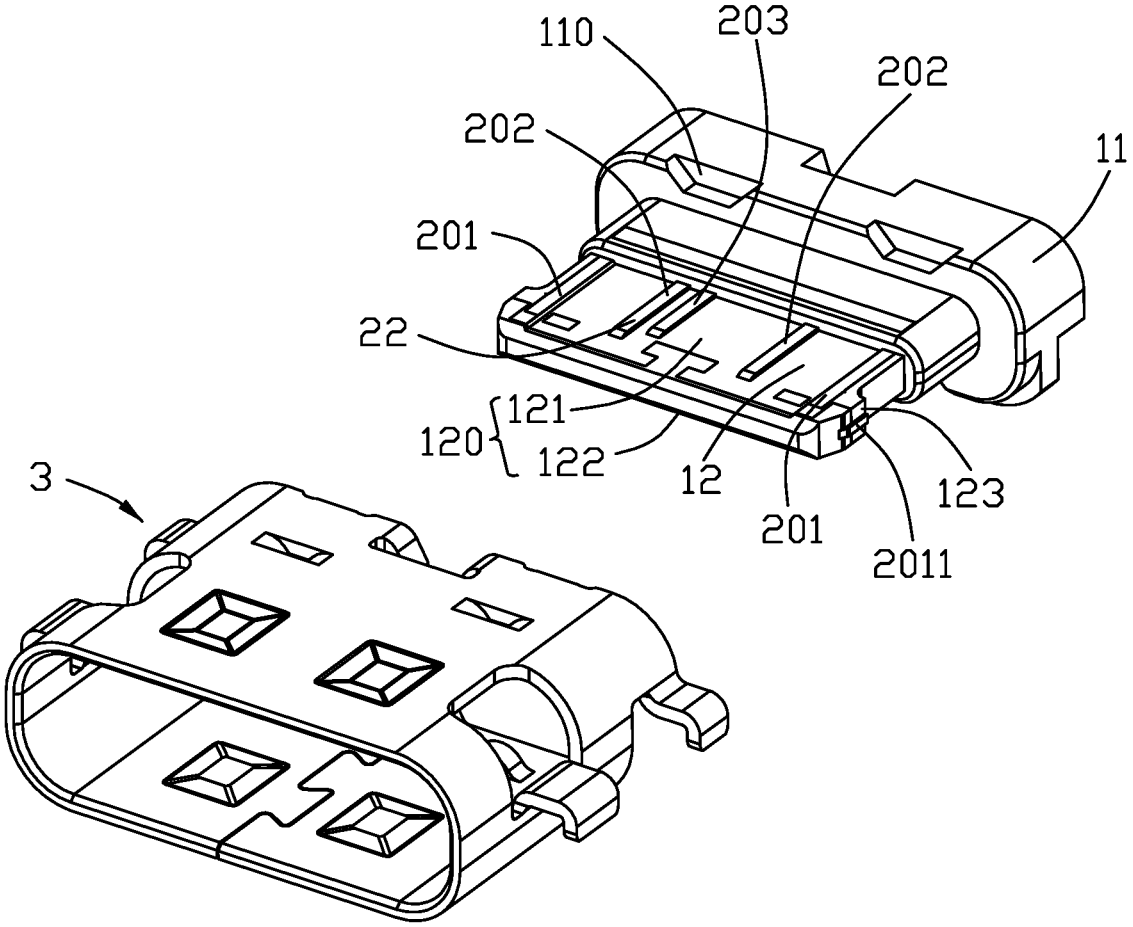
FIG. 3 is an exploded view of the electrical connector in FIG. 1.
Figure 4:
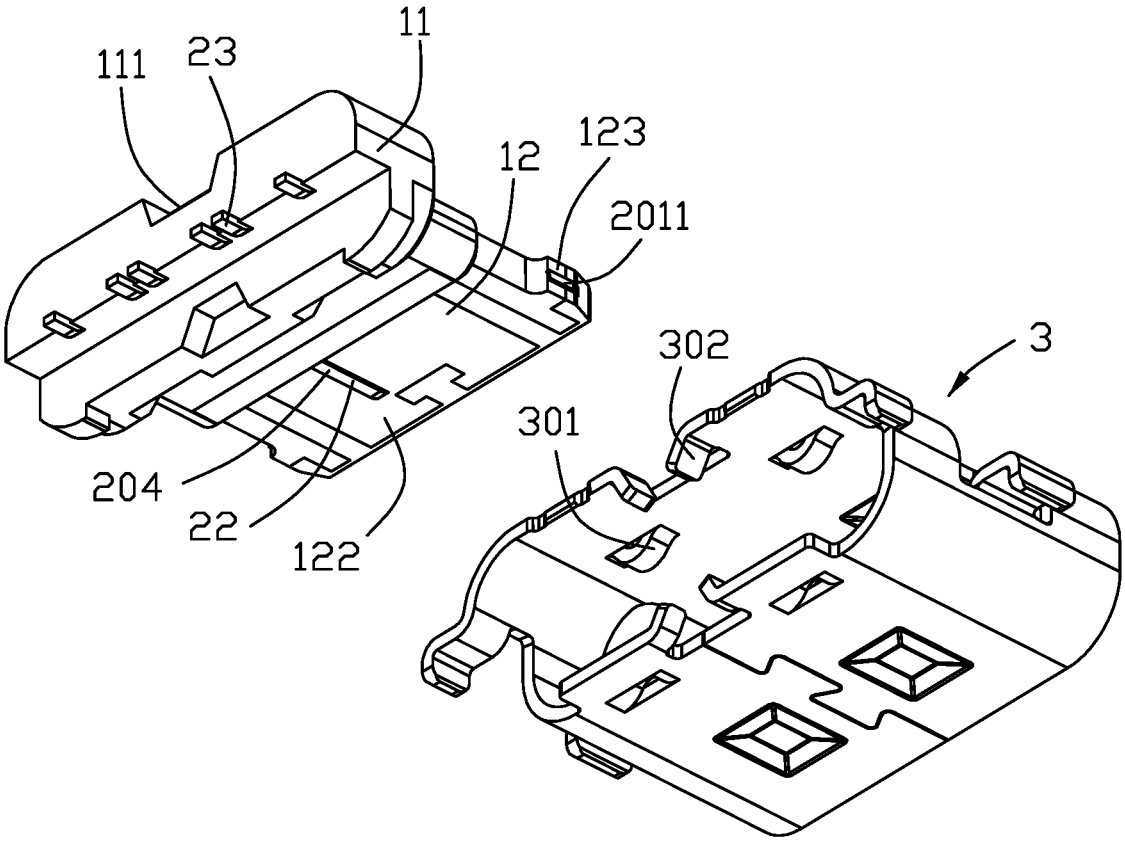
FIG. 4 is an exploded view of the electrical connector in FIG. 2.
Figure 5:
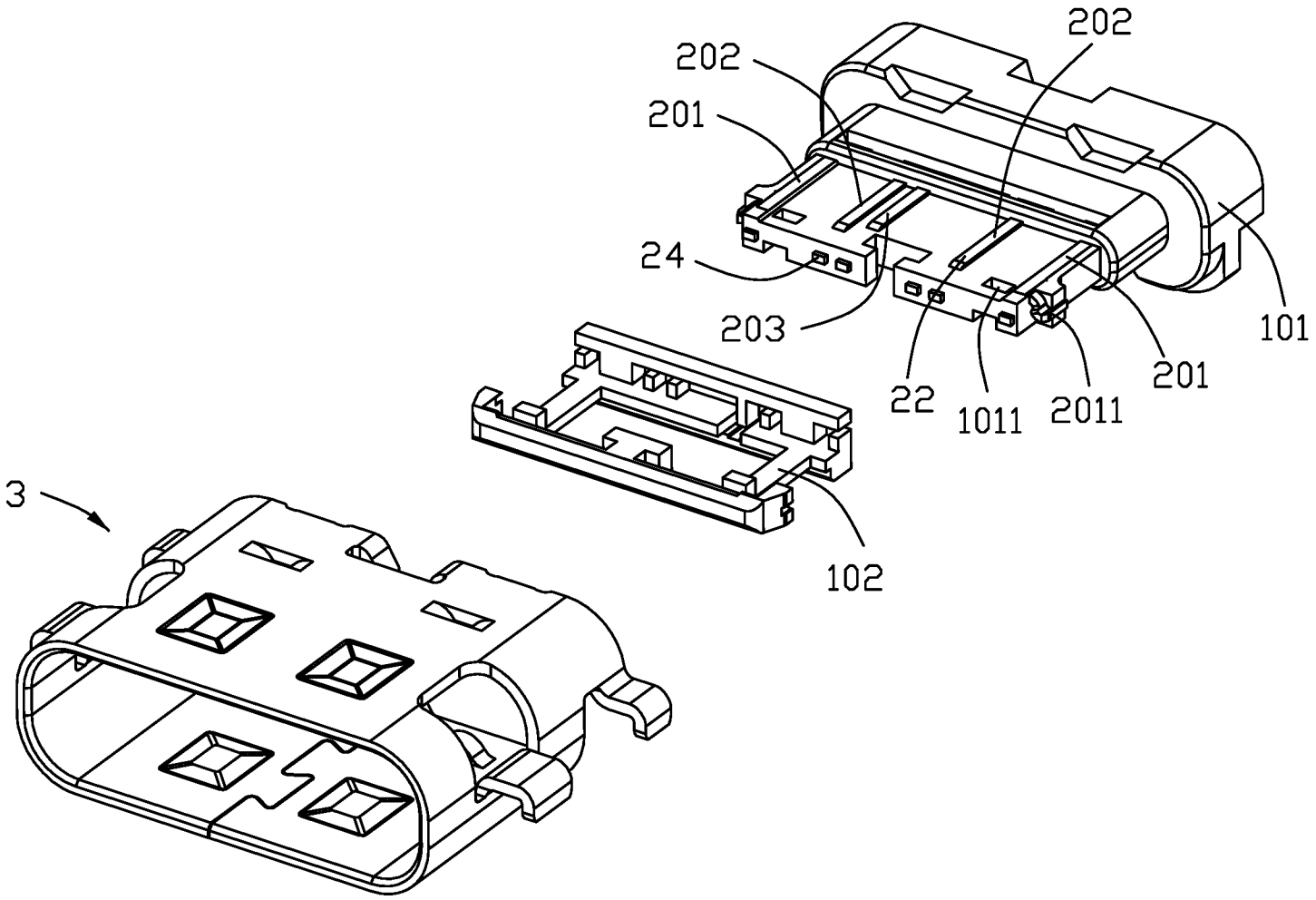
FIG. 5 is a further exploded view of the electrical connector in FIG. 3.
Figure 6:
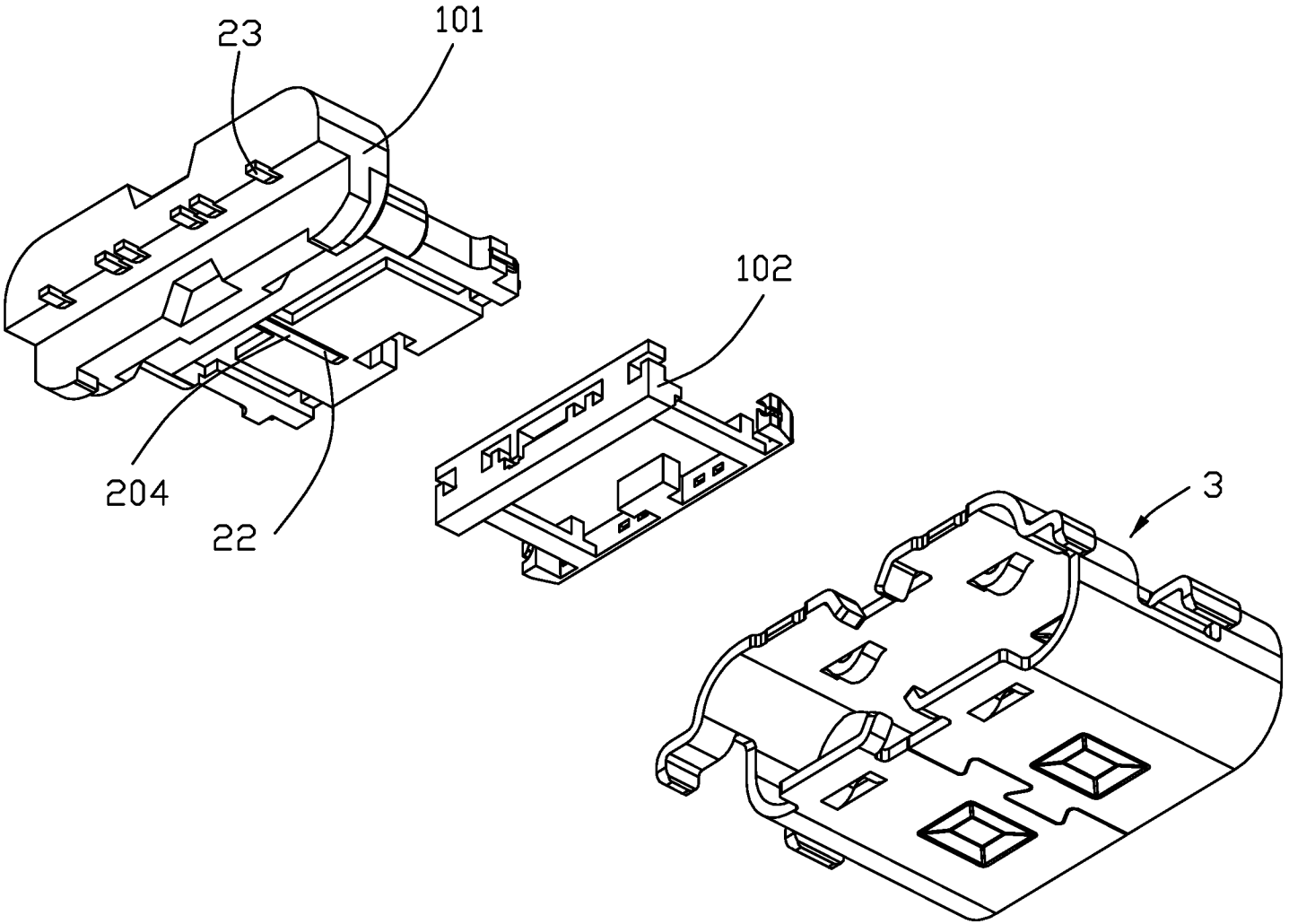
FIG. 6 is a further exploded view of the electrical connector in FIG. 4.
Figure 7:
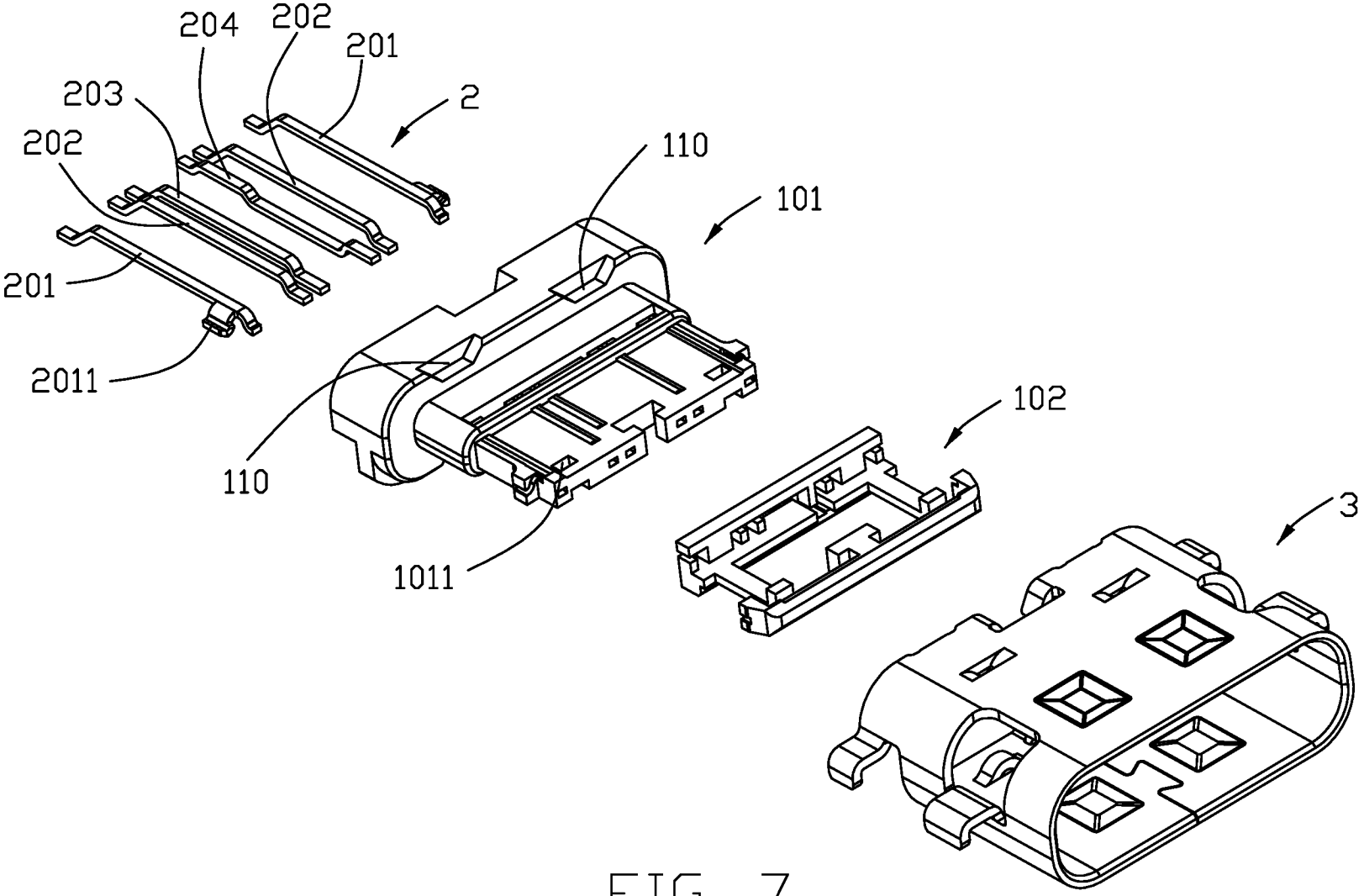
FIG. 7 is a further exploded view of the electrical connector in FIG. 5 from a different perspective.
Figure 8:
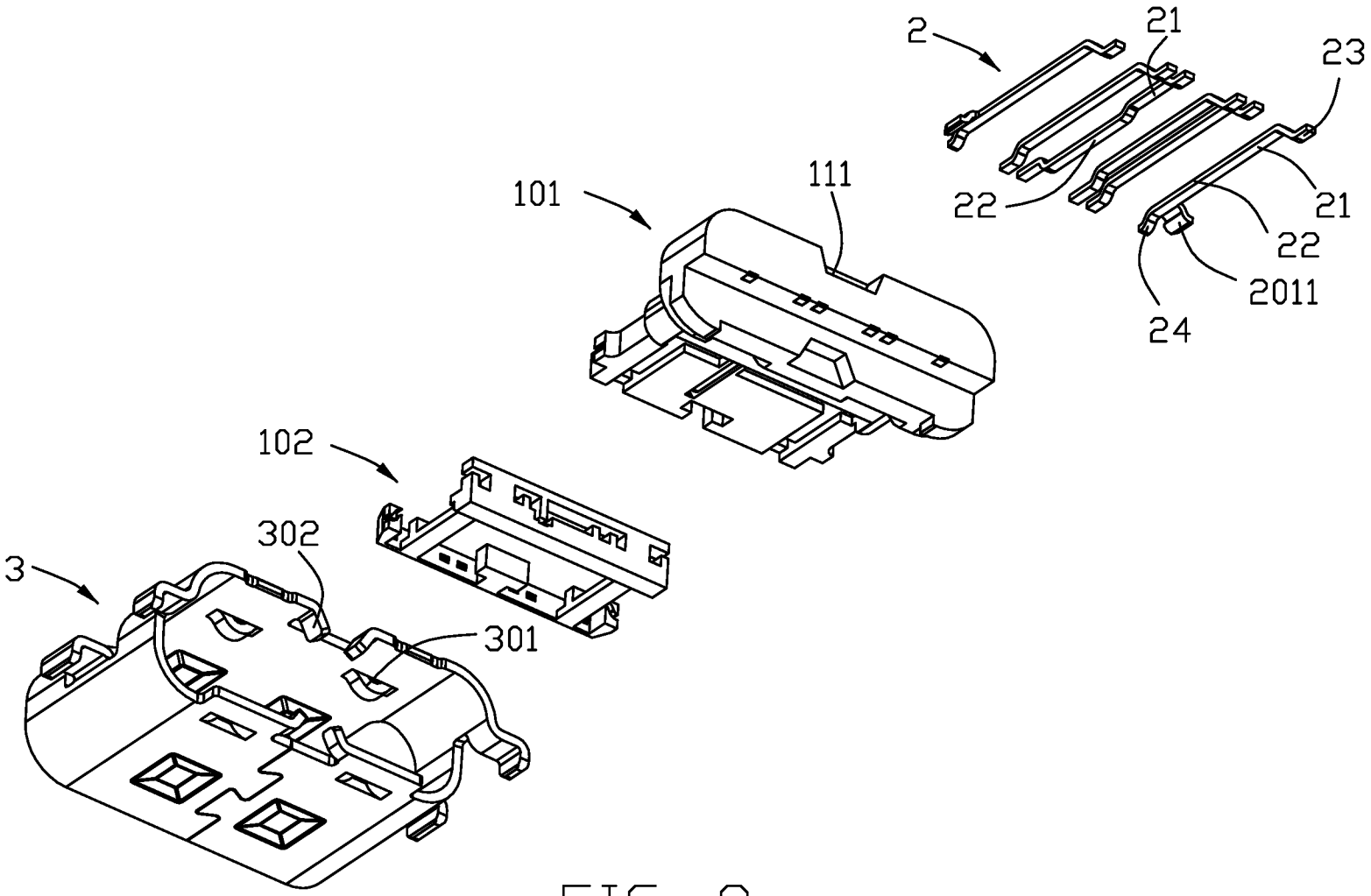
FIG. 8 is a further exploded view of the electrical connector in FIG. 6 from a different perspective.
Figure 9:
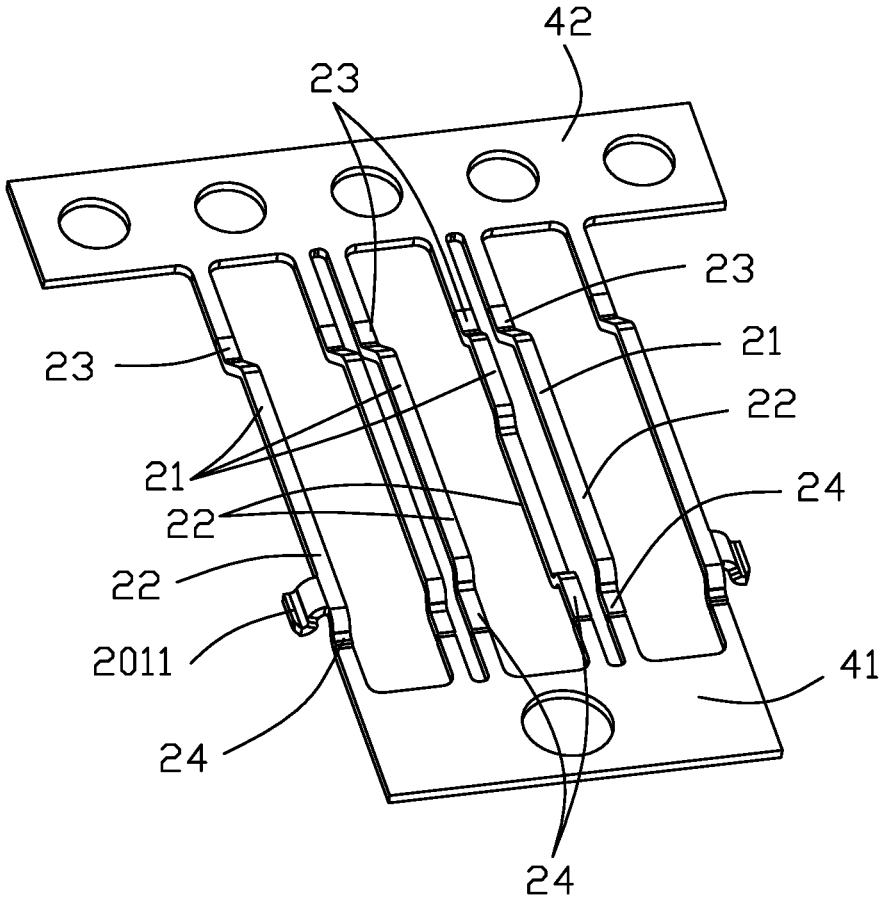
FIG. 9 shows a plurality of contacts of the electrical connector formed on a single contact carrier.

Referring to FIGS. 1-13, an electrical connector 100 in accordance with the present invention is embodied as a USB Type C receptacle connector for charging purpose and comprises an insulative housing 1 and a plurality of contacts 2 secured to the insulative housing 1. The electrical connector 100 may further comprise a shielding shell 3 enclosing the insulative housing 1 to form a mating space 31.

The insulative housing 1 has a base 11 and a frontal tongue 12. Each contact 2 has a securing portion 21, a front contacting portion 22 exposing to a corresponding mating surface 120 of the tongue 12, and a rear soldering portion 23. The plurality of contacts 2 include two outermost ground contacts 201, two power contacts 202 immediately adjacent to the two ground contacts 201, and a first and second detect contacts 203 and 204. The tongue 12 has opposite first and second surfaces 121 and 122. The contacting portions 22 of the two outermost ground contacts 201, the two power contacts 202, and the first detect contact 203 are exposed to the first surface 121, forming an upper row. The contacting portion 22 of the second detect contact 204 is exposed to the second surface 122, forming a lower row. The base 11 has a pair of front positioning grooves 110 and the shielding shell 3 has a pair of positioning pieces 301. The base 11 further has a rear positioning groove 111 and the shielding shell 3 further has a pair of rear positioning pieces 302.

Each of the first and second surfaces 121 and 122 of the tongue 12 provides twelve (12) contact positions arranged centrally-symmetrically to support dual-orientation mating as is well known in this art, though not all contact positions are occupied. In the embodiment shown, on the first surface 121, the two ground contacts 201 occupy the first and twelfth contact positions, the two power contacts 202 occupy the fourth and ninth contact positions, and the first detect contact 203 occupies the fifth contact position; on the second surface 122, the second detect contact 204 occupies the fifth contact position.

Figure 10:
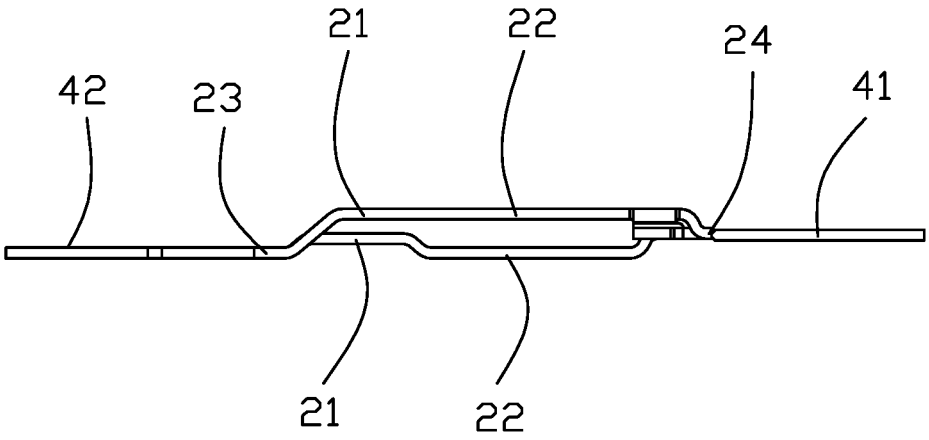
FIG. 10 is a side view of the contact carrier.
Figure 11:
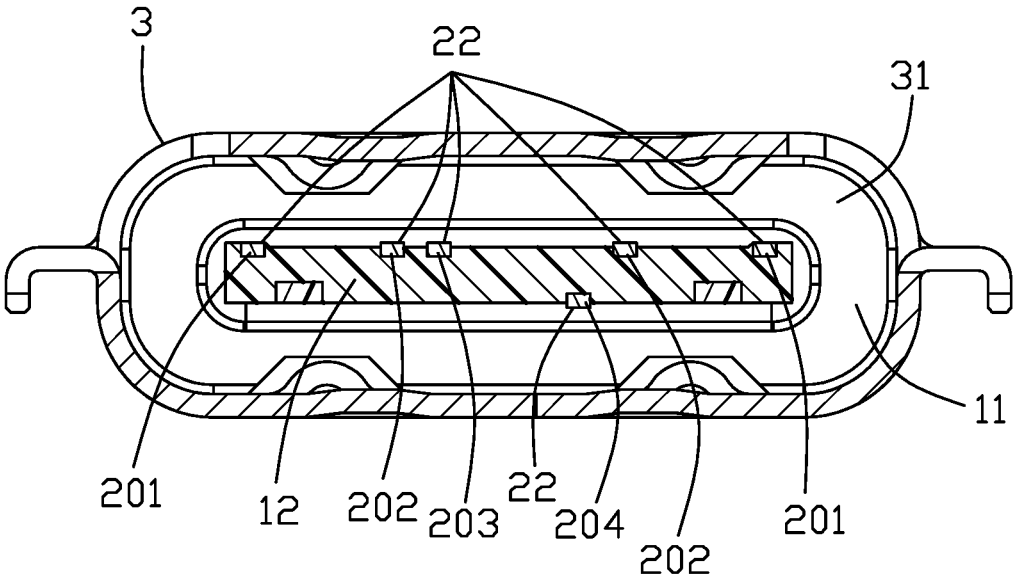
FIG. 11 is a cross-sectional view of the electrical connector taken along line 11-11 in FIG. 1.

Each of the two outermost ground contact 201 has an integral latching portion 2011 which is located at the side locking protrusion 123 of the tongue 12 and outwardly and laterally exposed to the exterior for mechanically and electrically connecting to the corresponding latch of the complementary plug connector inserted into the electrical connector 100. As shown in FIG. 10, there is a bend at a junction between the contacting portion 22 and the securing portion 21 of the second detect contact 204 exposed to the second surface 122, while the contacting portions 22 of the two outermost ground contacts 201, the two power contacts 202, and the first detect contact 203 exposed to the first surface 121 are coplanar with the securing portions 21 thereof. The reason why there is a bend between the contacting portion 22 and the securing portion 21 in the second detect contact 204 while those of other contacts 2 have none is to have all contacts 2 have the same length between the first carrier strip 41 and the second carrier strip 42 when all the contacts 2 are in an extended manner before forming.

The soldering portions 23 of the two outermost ground contacts 201, the two power contacts 202, and the first and second detect contacts 203 and 204 are coplanar. Respective front ends of the two outermost ground contacts 201, the two power contacts 202, and the first and second detect contacts 203 and 204 are bent to form coplanar heads 24 embedded in the tongue 12. During manufacturing, the front ends of the two outermost ground contacts 201, the two power contacts 202, and the first and second detect contacts 203 and 204 are connected to a first carrier strip 41, and rear ends thereof are connected to a second carrier strip 42. The insulative hosing 1 is constructed of a first insulator 101 molded with the two outermost ground contacts 201, the two power contacts 202, and the first and second detect contacts 203 and 204 and a second insulator 102 over-molding the first insulator 101 and embedding the front ends of all the contacts as well as filling up mold holes 1011).

Therefore, to make a contact module of the electrical connector 100, the method may include primarily a step of forming the plurality of contacts 2 from a single contact carrier to have at least the first and second detect contacts 203 and 204 with the contacting portions 22 thereof oriented reversely-symmetrically with respect to each other and to have the two outermost ground contacts 201 with the latching portions 2011; a step of insert-molding the plurality of contacts 2 with the first insulator 101 while exposing the front ends 24 thereof and the latching portions 2011; a step of severing the carrier strip 41 from the front ends 24 of the plurality of contacts 2; and a step of over-molding the second insulator 102 to the first insulator 101 and embedding the front ends 24 of the plurality of contacts 2 to form the tongue 12. The shielding shell 3 may then be assembled and the second carrier strip 42 severed, as is well known in this art. Since the latching portion 2011 has a generally curved surface, during the insert-molding step, a respective outer part of the first surface 121 of the tongue 12 that is immediately outwardly of each ground contact 201 may be molded to a level that is coplanar with a top surface of the ground contact and effectively covers the latching portion 2011, which makes the molding operation easier without fear of spilling over.

Figure 12:
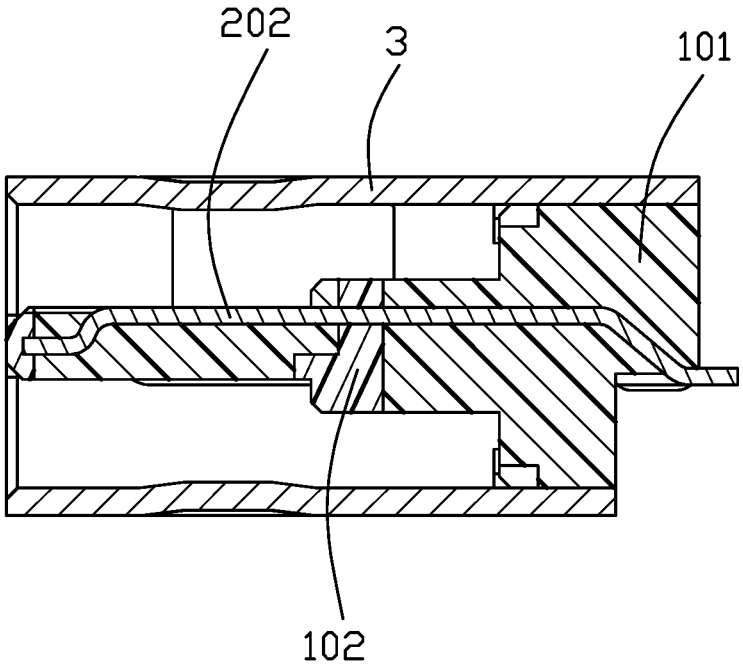
FIG. 12 is a cross-sectional view of the electrical connector taken along line 12-12 in FIG. 1.
Figure 13:
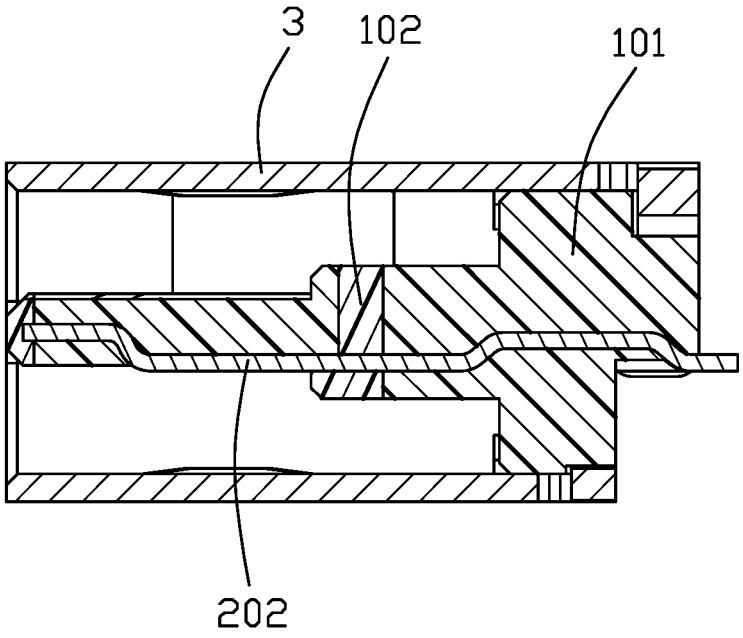
FIG. 13 is a cross-sectional view of the electrical connector taken along line 13-13 in FIG. 1.

As shown in FIGS. 12 and 13, different from the traditional connector in which because of the middle shielding plate between the upper contacts and the lower contacts, the front end of the upper contact is essentially located in the upper half of the tongue and the front end of the lower contact is essentially located in a lower half the tongue, in the instant invention because of no middle shielding plate between the upper contacts and the lower contacts, both the front end of the upper contact and that of the lower contact are located at the same middle level of the tongue 12, thus assuring retention of the contact in the tongue 12.

As shown in the figures and well known in the field, there are originally twelve contacts on each surface of the tongue wherein the first and the twelfth are of the grounding contacts 201 and the fourth and the ninth are of the power contacts 202. The detect contact 203, 204 is located at the fifth position. The instant invention is a simplified version with only the power contacts and the grounding contacts on one surface of the tongue while maintaining the respective detect contacts at two opposite surfaces thereof for assuring the correct electrical transmission when the corresponding plug connector is inserted into the electrical connector 100. On one hand, because of this specific arrangement of the contacts, it is allowed to have all contacts 2 formed between the first carrier strip 41 and the second carrier strip of the same sheet metal for simultaneous insert-molding. On the other hand, the because the contacting portion 22 and the securing portion 21 of the upper contact and those of the lower contact have the different distances with regard to the corresponding soldering portions 23, it requires to form the corresponding bend between the contacting portion 22 and the securing portion 21 for the second detect contact 204, compared with the first detect contact 204 without such a bend between the corresponding securing portion 21 and the contacting portion 22.

What is claimed is:

1. An electrical connector comprising:

an insulative housing having a front tongue with two opposite surfaces; and a plurality of contacts with contacting portions exposed to the two opposite surfaces of the tongue; wherein the plurality of contacts are formed from a single contact carrier to have one contact thereof with a first contacting portion oriented reversely-symmetrically with respect to a second contacting portion of another contact thereof and to have two outermost contacts each with a respective integral latching portion outwardly and laterally exposed to an exterior for connecting to a corresponding latch of an inserted complementary plug connector;

respective front ends of the plurality of contacts are embedded in the tongue; and said one contact has a first securing portion connected to the first contacting portion in a coplanar manner while said another contact has a second securing portion connected to the second contact portion with a bend therebetween.

2. The electrical connector as claimed in claim 1, wherein said one contact further has a first soldering portion and said another contact further has a second soldering portion coplanar with the first soldering portion.

3. The electrical connector as claimed in claim 1, wherein the first securing portion and the second securing portion are not located at a same level while the front end of said one contact and that of said another contact are at a same level.

4. An electrical connector comprising:

an insulative housing including a rear base and a front tongue forwardly extending from the base in a front-to-back direction, said tongue defining opposite first and second surfaces in a vertical direction perpendicular to the front-to-back direction;

a plurality of contacts stamped from and unitarily formed between opposite first carrier strip and second carrier strip of a same sheet metal, each of said contacts including a contacting portion exposed upon the front tongue, a securing portion retained in the base, and a soldering portion exposed outside of the housing;

the contacting portion of all contacts except at least one contact being exposed upon the first surface while that of said at least one contact being exposed upon the second surface; wherein the soldering portions of all the contacts are located at a same horizontal plane; and there are twelve positions in each surface of the tongue for the contacts, and all the contacts except said at least one contact are located at positions one, four, five, nine, and twelve on the first surface, and said at least one contact is located at position five on the second surface.

5. The electrical connector as claimed in claim 4, wherein except said at least one contact, all securing portions are coplanar with the corresponding contacting portion while in said at least one contact, a bend is formed between the securing portion and the corresponding contacting portion.

6. The electrical connector as claimed in claim 4, wherein front ends of all contacts are located at a same level.

7. The electrical connector as claimed in claim 6, wherein said level is higher than said horizontal plane.

8. The electrical connector as claimed in claim 6, wherein said level is a mid-level of the front tongue in said vertical direction.

9. The electrical connector as claimed in claim 6, wherein the housing includes a first insulator and a second insulator, and the front ends of all the contacts are embedded within the second insulator.

10. The electrical connector as claimed in claim 4, wherein each of the contacts at positions one and twelve is further equipped with an integral latching portion outwardly exposed to an exterior.

11. The electrical connector as claimed in claim 10, wherein the integral latching portion is located at a mid-level of the tongue in said vertical direction.

12. The electrical connector as claimed in claim 10, wherein said integral latching portion is embedded within a side locking protrusion of the tongue.

13. An electrical connector comprising:

an insulative housing having a front tongue with two opposite surfaces; and a plurality of contacts with contacting portions exposed to the two opposite surfaces of the tongue; wherein the plurality of contacts are formed from a single contact carrier to have one contact thereof with a first contacting portion oriented reversely-symmetrically with respect to a second contacting portion of another contact thereof and to have two outermost contacts each with a respective integral latching portion outwardly and laterally exposed to an exterior for connecting to a corresponding latch of an inserted complementary plug connector; and respective front ends of the plurality of contacts are embedded in the tongue and at a mid-level of the front tongue.

* * * * *